US007717643B2

(12) United States Patent
Han

(10) Patent No.: US 7,717,643 B2
(45) Date of Patent: May 18, 2010

(54) ENVIRONMENTAL AFFINITY TYPE HYDROPHILIC REVETMENT BLOCK AND CONSTRUCTION METHOD THEREOF

(76) Inventor: Jae Myung Han, 500-1, Jeungsan-ri, Seokseong-myeon, Buyeo-gun, Chungcheongnam-do 323-952 (KR)

( * ) Notice: Subject to any disclaimer, the term of this patent is extended or adjusted under 35 U.S.C. 154(b) by 290 days.

(21) Appl. No.: 11/574,727

(22) PCT Filed: Oct. 12, 2005

(86) PCT No.: PCT/KR2005/003393

§ 371 (c)(1),
(2), (4) Date: Mar. 6, 2007

(87) PCT Pub. No.: WO2006/107128

PCT Pub. Date: Oct. 12, 2006

(65) Prior Publication Data

US 2008/0075535 A1 Mar. 27, 2008

(30) Foreign Application Priority Data

Mar. 11, 2005 (KR) ..... 10-2005-0020442

(51) Int. Cl.
*E02B 3/14* (2006.01)

(52) U.S. Cl. ..... 405/33; 405/16

(58) Field of Classification Search ..... 405/34, 405/35, 21, 30, 31, 33, 15, 16, 17
See application file for complete search history.

(56) References Cited

U.S. PATENT DOCUMENTS 4,813,812 A 3/1989 Hasegawa et al.

(Continued)

FOREIGN PATENT DOCUMENTS

JP S58-171917 11/1983

(Continued)

OTHER PUBLICATIONS

International Search Report for PCT/KR2005/003393, mailed Feb. 9, 2006, 2 pgs.

(Continued)

*Primary Examiner*—Sunil Singh
(74) *Attorney, Agent, or Firm*—Squire, Sanders & Dempsey, L.L.P.

(57) ABSTRACT

The present invention relates to a hydrophilic revetment block constructed on the slope of seashore, harbor, river, reservoir, dam, etc. Whereas conventional revetment blocks are focused on their individual functional advantages, the revetment block of the present invention offers a variety of functions, namely, space for plants, conservation of ecosystem and protection of lakeshore through wave dissipation and reduction of water flow rate at once. On the block is provided a space for plants. The block is constructed lower than the water surface to offer living space for fish. Projections are formed at the front bottom of the block to prevent collapse of a revetment block by waves or water flow. The projections serve the purpose of stirs, so that people may have easy access to the shore. The space for water outflow and fish growing dissipates the energy of the water which flowed in through the water inlets formed at the bottom of the block, thereby offering better stability.

9 Claims, 5 Drawing Sheets

U.S. PATENT DOCUMENTS

| | | | | |
|---|---|---|---|---|
| 6,547,487 | B2 | 4/2003 | Won-Hoi | |
| 2006/0275081 | A1* | 12/2006 | Medina Folgado et al. | 405/15 |
| 2008/0089743 | A1 | 4/2008 | Han | |

FOREIGN PATENT DOCUMENTS

| | | | | |
|---|---|---|---|---|
| JP | 03169916 | A | * | 7/1991 |
| JP | 2001317029 | A | * | 11/2001 |
| JP | 2004027539 | A | * | 1/2004 |
| KR | 10-1997-0001750 | | | 2/1997 |
| KR | 10-0243778 | | | 11/1999 |
| KR | 20-0224547 | | | 12/2000 |
| KR | 20-0262814 | | | 3/2002 |
| KR | 20-0303564 | | | 1/2003 |
| KR | 10-2004-0032694 | | | 4/2004 |

OTHER PUBLICATIONS

Written Opinion of the International Searching Authority for PCT/KR2005/003393, mailed Feb. 9, 2006, 3 pgs.

* cited by examiner

ENVIRONMENTAL AFFINITY TYPE HYDROPHILIC REVETMENT BLOCK AND CONSTRUCTION METHOD THEREOF

TECHNICAL FIELD

The present invention relates to a hydrophilic revetment block constructed on the slope of seashore, harbor, river, reservoir, dam, etc. to prevent the embankment or road from being swept by waves or water, more particularly to an environment-friendly, multipurpose, hydrophilic revetment block offering the advantage of wave dissipation, bank protection, flora protection and fish protection while providing stairs and a construction method thereof.

BACKGROUND ART

Conventional hydrophilic revetment blocks are limited to a certain function, to name a few, wave dissipation, stairs offering, bank protection, etc., and are constructed focused only on each of the functions. Thus, they lack versatility.

To give specific examples, the revetment block disclosed in Korean Utility Model No. 20-0262814 is a hydrophilic stand constructed on seashore or lakeshore. Its main purpose is to offer stairs by which people can travel conveniently and it does not consider the function of flora protection or fish protection. Korean Utility Model No. 20-0224547 discloses a hollow block which offers protection of lakeshore from waves of the high seas while providing stairs. However, it does not provide flora protection or fish protection.

Korean Patent No. 10-0243778 discloses a square block which offers space for water plants and fish so that sunlight may arrive underwater ground through a hole formed in the block. But, it neither provides stairs or space for plants nor offers sufficient wave dissipation. Korean Patent Publication No. 10-2004-0032694 discloses a revetment block constructed on the slope of lakeshore in the form of stairs. It provides a certain extent of wave dissipation function through circular seawater passage holes and offers a convenient travel route for people. But, it does not provide space for plants or fish. Korean Patent Publication No. 10-1997-001750 discloses a penetration type concrete block and stairs using the block. The patent has been partly applied in Korea. Although the passage formed in the block offers wave dissipation and traveling route for people, space for plants or fish is not adequately provided.

There are several other hydrophilic revetment blocks, but none offers the various functional advantages provided by the present invention. For this reason, environmental organizations are hostile to most of seashore or river bed constructs.

DISCLOSURE OF INVENTION

Technical Problem

Accordingly, it is an object of the present invention to provide an environment-friendly, multipurpose, hydrophilic revetment block capable of fundamentally solving the problems posed by the conventional revetment blocks and a construction method thereof.

Technical Solution

The present invention provides an environment-friendly hydrophilic revetment block that can be applied broadly in seashores, harbors, rivers, dams and reservoirs. Provided are an environment-friendly, multipurpose, hydrophilic revetment block having a space for plants on top of the block, a projection in the front of the block, which dissipates the energy of waves or flowing streams initially and offers stairs, and a water inlet and a water outlet at the bottom of the block, which completely dissipate residual energy, thereby pacifying water flow, and offer a living space for fish, and a construction method thereof.

To be specific, in one embodiment of the present invention, a base block of a hydrophilic revetment block constructed on seashores, harbors, rivers, reservoirs or dams is provided, which comprises: a block structure having a plurality of water inlets, a space for water outflow and fish growing and a plurality of water outlets; an stepped part for preventing push, which is formed on a certain section of the top of the block structure; a plurality of projections and indentations for engagement formed on both sides of the block structure for preventing differential settlement; a space for plants formed on a certain section of the stepped part for preventing push, where plants can grow; and a plurality of projections formed in front of the block structure, which reduce the rate of water flow, dissipate waves and offer stairs.

The plurality of water inlets, through which water flows in, are formed with the same size in between the projections. They are connected to space for water outflow and fish growing at the bottom of the block structure.

The space for water outflow and fish growing has a cross section larger than the water inlets. When viewed from the side of the block, it has a trapezoidal shape and it meets with the water inlets in "T" form.

The plurality of water outlets are sloped from the top of the block structure to the space for water outflow and fish growing at the bottom of the block structure.

The stepped part is for preventing the block from being pushed to the front by backside earth pressure during construction. The space for plants can be planted with various plants to offer an environment-friendly hydrophilic revetment block.

The plurality of projections formed in the front of the block structure not only reduce the rate of water flow and dissipate waves but also serve as stairs so that people can easily access to the shore, depending on variation of the rise or fall of the sea level or the water level of the river. The plurality of projections are formed such that the size of the projection at the center is almost the same as the sum total of the size of the projections formed on either end. The upper and lower blocks are constructed in zigzags in order to prevent differential settlement.

Between the projections in the front of the block are provided passages through which the dissipated wave or water flows in. At the bottom inside the block is formed the space for water outflow and fish growing which meets with the inflow water in "T" form. The water outlets connected with the living space with a slope dissipate the energy of inflow water to every direction, thereby pacifying the water.

The projections and indentations for engagement at each side of the block are constructed to be engaged with each other to further improve the stability of the block.

If required, suspension rings or nuts may be provided at the top or side of the block for easy transportation of the block.

In another embodiment of the present invention, a bottom foundation block of a hydrophilic revetment block constructed on the bottom of the base block described above is provided, which comprises: a block structure which is longer than the base block for stable construction; a pair of projections formed at the top of the block structure which engage with the bottom of the base block and prevents the base block from being pushed along the longitudinal direction of the block; a pair of projections formed at the bottom of the block structure with a predetermined spacing for increasing friction with the ground; and projections and indentations for engagement formed on both sides of the block structure, which engage with each other for preventing differential settlement.

One of the pair of projections for preventing push is formed in the front of the block structure and has a square shape when viewed from the side of the block. The other is formed at the middle of the block structure and has a trapezoidal shape when viewed from the side of the block. The pair of projections for preventing push are formed with a predetermined spacing so that they can engage with the bottom of the base block. And, the trapezoidal projections, which engage with the space for water outflow and fish growing of the base block, are formed below the trapezoidal space for water outflow and fish growing in order to offer living space for fish.

As the projections and indentations formed on the outer circumference of the revetment block engage with each other, binding force between the revetment blocks increases, so that they are not displaced by waves or torrents of water. Also, resistance against the displacement of ground by, for example, differential settlement can be improved after the revetment block has been constructed. In addition, the projections for fixation to ground prevent the bottom of the block from being pushed against the ground.

In another embodiment of the present invention, a pair of side end blocks are provided at either side of the hydrophilic revetment block, each of which comprises: a block structure having a plurality of stairs; and a plurality of trapezoidal projections for engagement formed on the left side or right side of the block structure.

The plurality of projections for engagement are aligned with a slope and with a predetermined spacing, so that they engage with the space for water outflow and fish growing of the base block.

That is, the stairs are provided at the same height of the base block and the projections for engagement are formed on the left and right sides of the base block symmetrically so that they engage with the space for water outflow and fish growing of the base block.

In another embodiment of the present invention, a top end block is provided at the top of the hydrophilic revetment block, which comprises: a block structure having a plurality of water inlets, a space for water outflow and fish growing and a plurality of water outlets; an stepped part for preventing push formed on a certain sections of the top of the block structure; a plurality of projections and indentation for engagement, which are formed on either side of the block structure and are engaged with each other to prevent differential settlement; a space for plants formed at the stepped part for preventing push; and a plurality of projections formed in front of the block structure, which reduces inflow rate, dissipates waves and offers stairs.

The plurality of water inlets through which water can flow in are formed between the projections in the same size. They are connected to the space for water outflow and fish growing below the block structure. The space for water outflow and fish growing has a larger cross section than the water inlets and have a trapezoidal shape when viewed from the side of the block. It meets with the water inlets in "T" form.

The stepped part for preventing push is higher than the stepped part for preventing push of the base block, so that water may not flow over the block. The plurality of water outlets are connected to the space for water outflow and fish growing in a vertical direction, so that water flowed over the block, if any, may immediately flow out to the space for water outflow and fish growing.

This construction enables control of the height of the stepped part of the end block constructed at the top of the revetment block, thereby preventing overflow of water and expelling out any water flowed in through the water outlets.

In another embodiment of the present invention, the base block described above with the space for plants locked out is provided.

This base block can be applied to the site where a space for plants is not necessary. Other features are the same as the base block described above.

In another embodiment of the present invention, the base block described above with the space for plants replaced by natural stone or patterned stone is provided.

This base block can be applied to the site where a space for plants is not necessary. The natural stone or patterned stone may improve environmental friendliness.

In another embodiment of the present invention, the base block described above with a streamlined pattern or other pattern inscribed in front of the base block is provided.

This base block can be applied to the site where improvement of beauty is required.

In another embodiment of the present invention, the base block described above with the horizontal cross section having a trapezoidal or reversed trapezoidal shape, rather than a square shape, is provided.

This base block can be easily constructed at a curved place.

In another embodiment of the present invention, a construction method using the base block and the bottom foundation block, both described above, on seashore, river, reservoir, dam, etc. is provided, which comprises the steps of: constructing the base block and the bottom foundation block alternately to increase resistance against differential settlement of the ground; and stacking the base block and the base block repeatedly and alternately.

In another embodiment of the present invention, a construction method using the base block, the bottom foundation block, the side end block and the top end block of the hydrophilic revetment block of any of those described above on seashore, river, reservoir, dam, etc. is provided, which comprises the steps of: fixing the projections for fixation of the bottom foundation block to the ground; connecting the bottom foundation blocks horizontally while engaging each projection for engagement of the bottom foundation block with the each indentation for engagement of the bottom foundation block; constructing the base block on the bottom foundation block by engaging the trapezoidal projections for preventing push of the bottom foundation block with the trapezoidal space for water outflow and fish growing of the base block; connecting the base blocks horizontally while engaging each projection for engagement of the base block with each indentation for engagement of the base block; stacking the base block and the base block repeatedly and alternately in order to improve resistance against differential settlement of the ground; finishing both ends by engaging the plurality of trapezoidal projections for engagement formed on the left or right side of the side end block with the space for water outflow and fish growing of the base block; and finishing the top by stacking the top end block on top of the base block repeatedly and alternately.

In this construction method, the bottom foundation block is fixed to the ground by fixing the projections for fixation formed at the bottom foundation block and repeatedly constructing the base block on the bottom foundation block in zigzags. As a result, resistance against differential settlement is improved. And, the stepped part of the top end block and the water outlets prevent overflow of water and water that has flowed in, if any, may be easily flowed out.

ADVANTAGEOUS EFFECTS

As apparent from the above description, the revetment block of the present invention, which comprises a base block, a bottom foundation block, a top end block and a side end block, offers convenient construction and improved stability after assembly. Whereas conventional revetment blocks are focused on individual functional advantages, thus causing a variety of problems associated with revetment block structure, the revetment block of the present invention offers space for plants, conservation of ecosystem and protection of lakeshore through wave dissipation and reduction of water flow rate at once, whereby satisfying the needs of multiple functions.

The stepped part for preventing push formed on the base block prevents the block from being pushed by backside earth pressure. The projections formed on the front of the block dissipates the energy of waves. Water flown in through the water inlets collides vertically with the water outlets formed at the bottom of the block, so that residual energy of the waves or water can be dissipated to every direction. Thus, the revetment block of the present invention sufficiently pacifies water, while offering stairs through which human being can reach the shore safely.

The bottom foundation block is provided for convenience of construction. On the top of the block are formed the projections for preventing push and at the bottom of the block are formed the projections for fixation to ground in order to prevent the block structure from being displaced by backside earth pressure. The top end block prevents overflow of water and lets any water flown in immediately flow out.

The revetment block also provides a space for plants and fish, where waves are dissipated and flow rate of water is reduced.

If required, the base block may have a trapezoidal or reverse trapezoidal shape, so that it can be constructed even on a curved region. The front part may be adorned with a pattern or natural stone. This environment-friendly, multipurpose, hydrophilic revetment block may not only reduce construction cost and construction period but also prevent various civil petitions from being filed.

BRIEF DESCRIPTION OF THE DRAWINGS

FIG. 1(*a*) is a plan view, FIG. 1(*b*) is a perspective view, FIG. 1(*c*) is a front view and FIG. 1(*d*) is a side view.

FIG. 3(*a*) is a plan view, FIG. 3(*b*) is a front view and FIG. 3(*c*) is a perspective view.

FIG. 4(*a*) is a plan view, FIG. 4(*b*) is a perspective view, FIG. 4(*c*) is a front view and FIG. 4(*d*) is a side view. The projections are symmetrical.

FIG. 5(*a*) is a plan view and FIG. 5(*b*) is a side view.

FIG. 7(*b*) is a side view of the hydrophilic revetment block with a space for plants. And, FIG. 7(*c*) is a side view of the hydrophilic revetment block of the present invention with the natural stone laid in the space for plants.

BEST MODE FOR CARRYING OUT THE INVENTION

Hereinafter, the present invention is described in further detail with reference to the attached drawings.

The revetment block of the present invention comprises a base block 10, a bottom foundation block 90, a side end block 110 and a top end block 100, each of which will be described in detail.

Base Block

Figure 1:
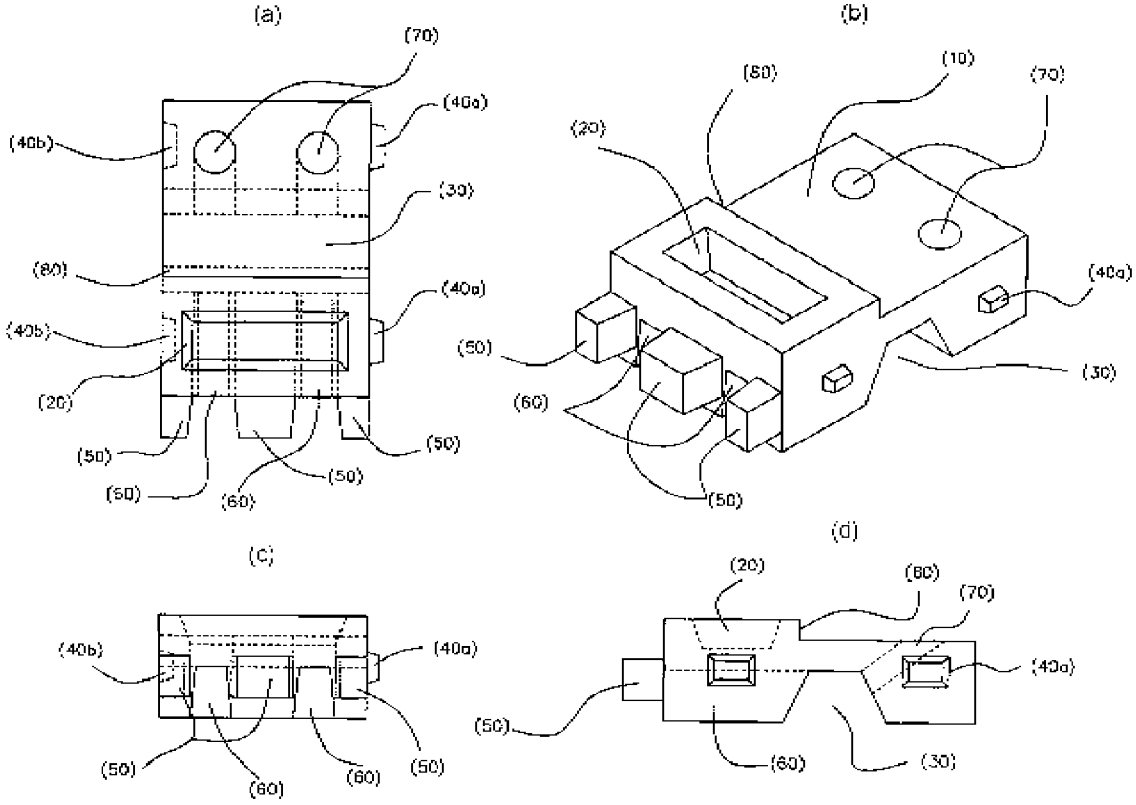
FIG. 1 illustrates the base block of the environment-friendly hydrophilic revetment block according to an embodiment of the present invention.
Figure 2:
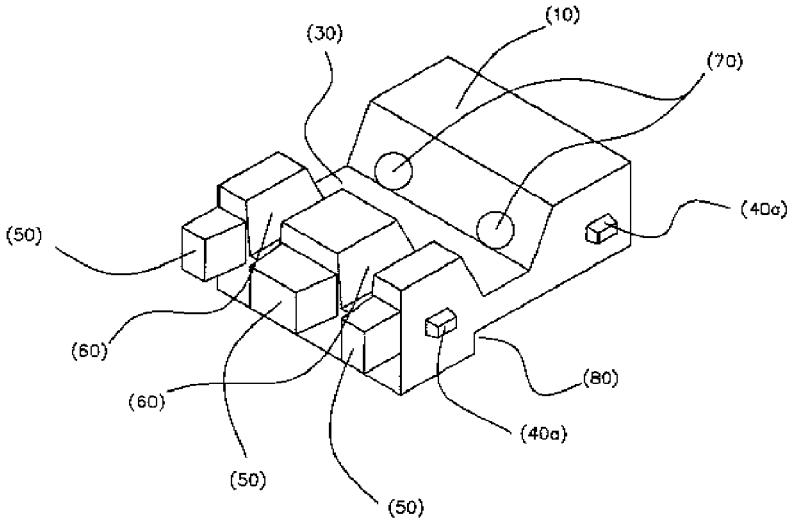
FIG. 2 is a perspective view of the base block of the environment-friendly hydrophilic revetment block according to an embodiment of the present invention, viewed from below.

FIG. 1 and FIG. 2 illustrate the base block 10 of the hydrophilic revetment block of the present invention. On the exposed part on the base block 10 is formed a bucket-shaped space for plants 20 where water plants or other various plants can grow. Depending on the situation of the site, natural stone 130 or other patterned stone may be laid in the space for plants 20. On one end is formed an stepped part for preventing push 80 which prevents the block from being pushed to the front by earth pressure along the slope. In the front of the block are formed projections 50 which reduce flow rate of water, dissipate waves and also serve stairs.

The projections 50 are formed such that the size of the projection at the center is almost the same as the sum total of the sizes of the projections on either end. The upper and lower blocks are constructed in zigzags in order to prevent differential settlement. Between the projections in the front of the block are formed water inlets 60 through which water flows in. At the bottom of the base block 10 is formed a space for water outflow and fish growing 30 which meets with the inflow water in "T" form. A plurality of water outlets 70 are formed along the slope which connects the top of the base block to the living space (see FIG. 1 and FIG. 2).

At the side of the base block 10 are formed indentations for engagement 40*b* and projections for engagement 40*a*. The space for plants 20 may be locked out depending on the situation of the site. And, the front may be curved rather than straight.

Bottom Foundation Block

Figure 3:
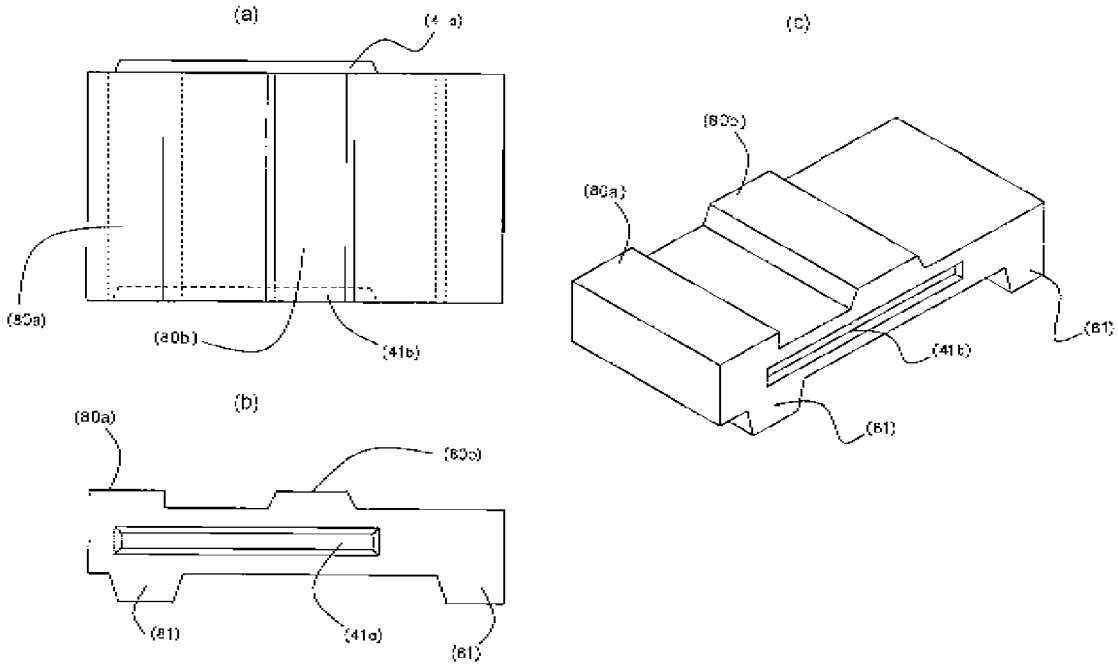
FIG. 3 illustrates the bottom foundation block according to an embodiment of the present invention.

FIG. 3 illustrates the bottom foundation block 90 of the hydrophilic revetment block of the present invention. The bottom foundation block 90 is constructed under the base block 10 for more convenient construction. On the bottom foundation block 90 are formed a pair of stepped parts for preventing push 80*a*, 80*b*, one of which has a square shape and the other has a trapezoidal shape when viewed from the side. The trapezoidal stepped part 80*b* is formed so that it engages with the trapezoidal space for water outflow and fish growing 30 formed at the bottom of the base block 10. But, it has a smaller size than the space for water outflow and fish growing 30 of the base block 10. Namely, the trapezoidal stepped part 80*b* is lower than the trapezoidal space for water outflow and fish growing 30 formed at the bottom of the base block 10, such that a living space for fish is provided (see FIG. 8).

The bottom foundation block 90 is formed so that it is longer than the base block 10 for stable construction. At the bottom of the bottom foundation block 90 are formed projections for fixation to ground 81, which prevent the entire block structure from being pushed. At the side of the bottom foundation block 90 are formed projections for engagement 41*a* and indentations for engagement 41*b* which engage with each other (see FIG. 8).

Side End Block

Figure 4:
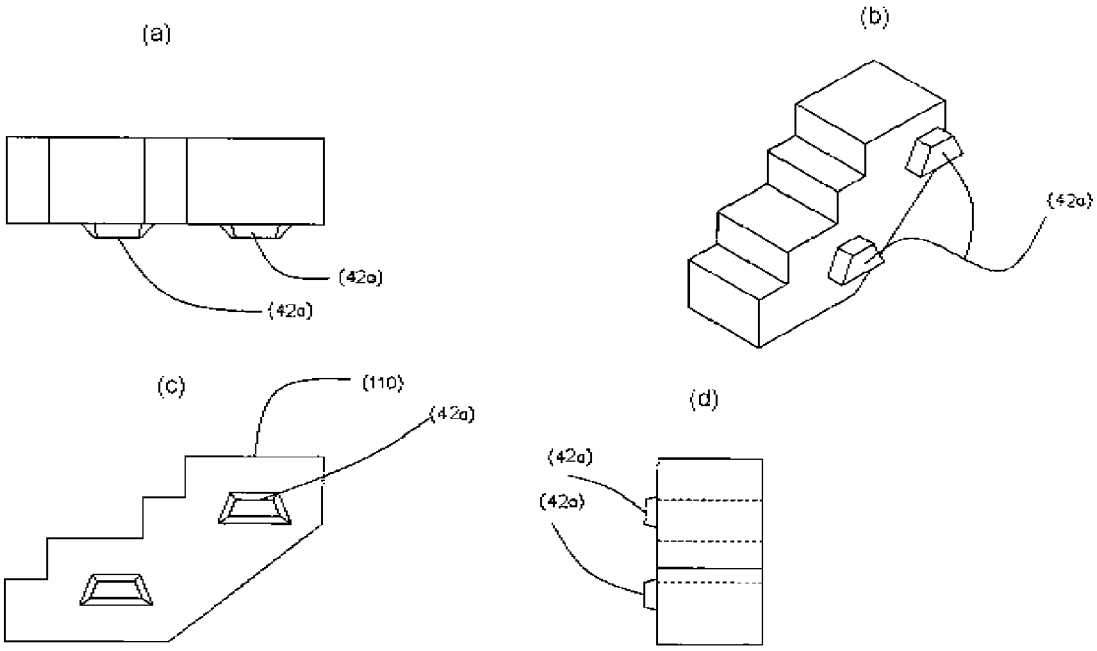
FIG. 4 illustrates the side end block constructed at each side end of the block according to an embodiment of the present invention.

FIG. 4 illustrates the side end block 110 of the hydrophilic revetment block of the present invention. The side end block 110 is constructed at each end of the block and may vary depending on the situation of the site. For example, if the base block 10 is constructed as stairs, the side end block 110 is also provided in the form of stairs.

On the left side or right side of the side end block 110 are formed projections for engagement 42*a* which engage with the space for water outflow and fish growing 30 of the base block for improving constructional stability.

Top End Block

The top end block 100 is formed on the top for finishing. The base block 10 may be used as the top end block 100, but the top end block 100 is formed higher than the stepped part for preventing push 80 in the front of the base block 10 to prevent overflow of water and let water flown in, if any, flow into the block through the water outlets 120 (see FIG. 1 and FIG. 5).

The block of the present invention may be made of concrete, composite materials using industrial byproducts, PE, etc.

Figure 5:
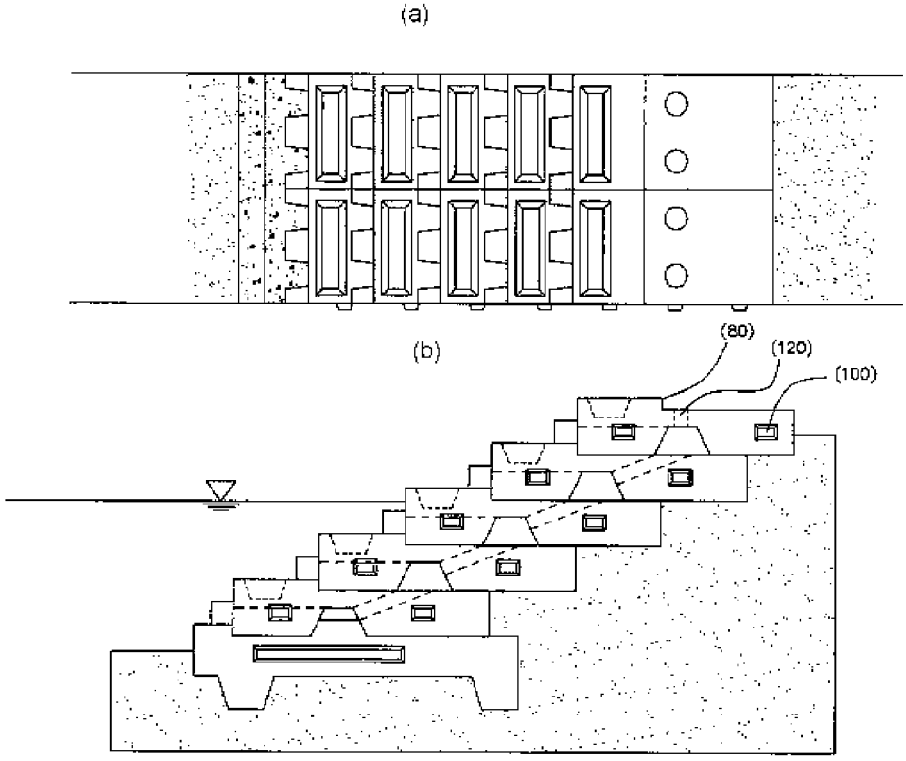
FIG. 5 illustrates the revetment block of the present invention before planting.

FIG. 5 illustrates the revetment block of the present invention before planting. FIG. 5(*a*) is a plan view and FIG. 5(*b*) is a side view. FIG. 5(*b*) explicitly shows that the water outlets 120 of the top end block 100 are formed vertically, while the water outlets 70 of the base block 10 are sloped.

Figure 6:
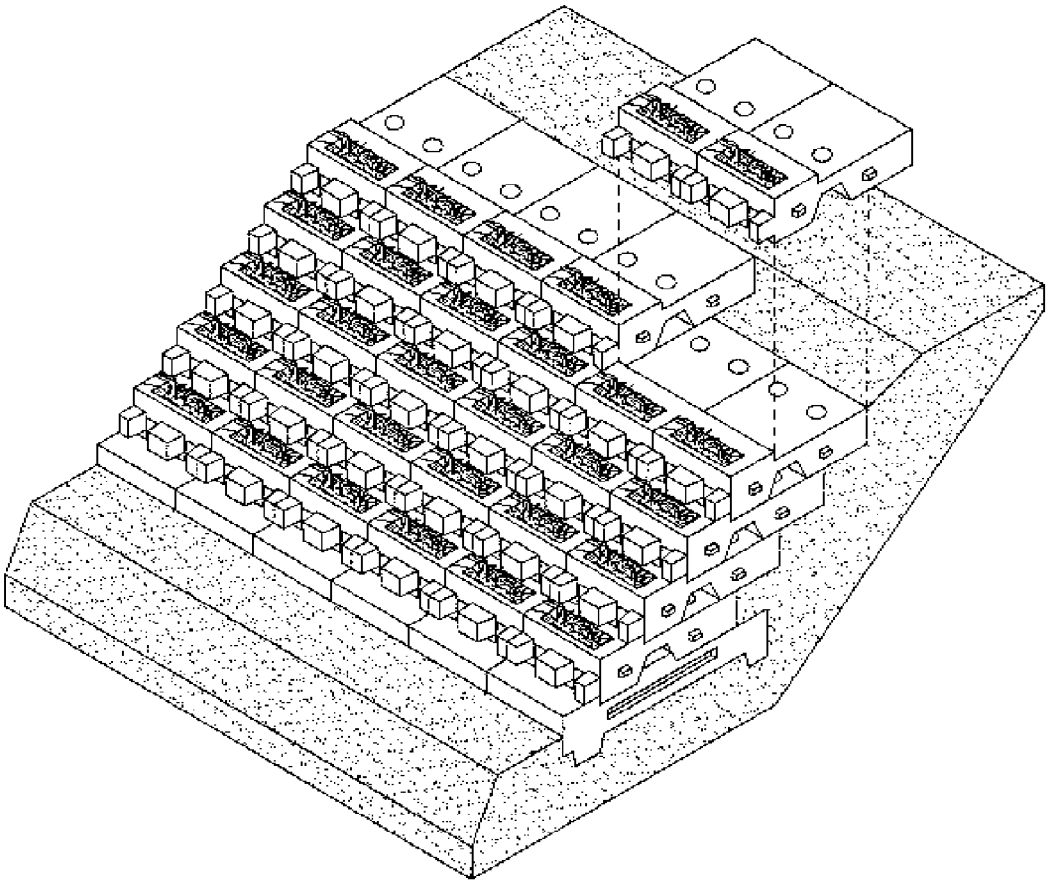
FIG. 6 is a perspective view of the revetment block of the present invention after planting.

FIG. 6 is a perspective view of the revetment block 10 of the present invention with the space for plants 20 planted.

Figure 7:
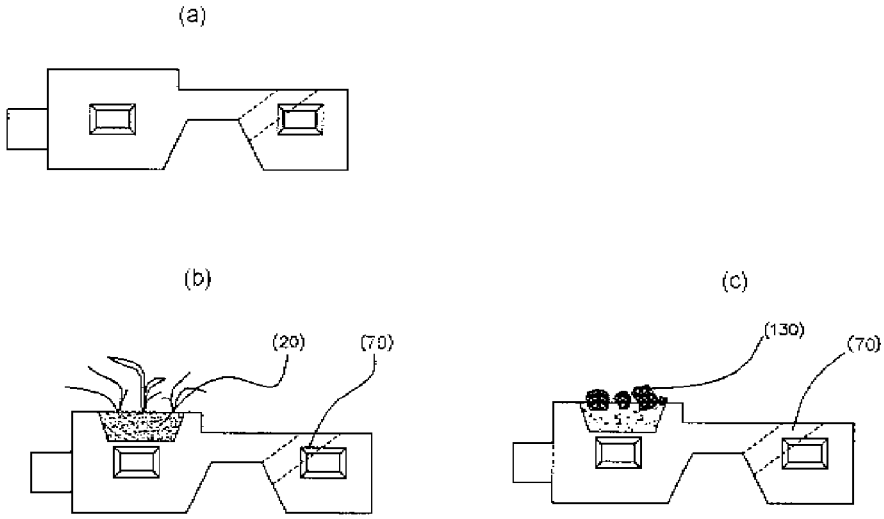
FIG. 7(*a*) is a side view of the hydrophilic revetment block of the present invention with no space for plants.

FIG. 7(*a*) is a side view of the hydrophilic revetment block of the present invention with no space for plants. FIG. 7(*b*) is a side view of the hydrophilic revetment block with a space for plants 20. And, FIG. 7(*c*) is a side view of the hydrophilic revetment block of the present invention with the natural stone 130 laid in the space for plants.

Figure 8:
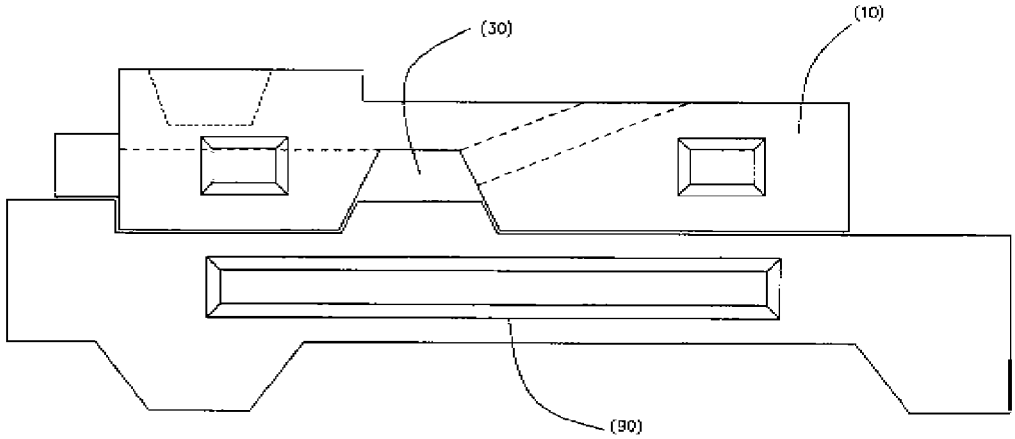
FIG. 8 is an exemplary view illustrating assembly of the base block and the bottom foundation block of the present invention.

FIG. 8 is an exemplary view illustrating assembly of the base block 10 and the bottom foundation block 90 of the present invention. In the figure, size and engagement status of the trapezoidal space for water outflow and fish growing 30 formed at the bottom of the base block with the trapezoidal projections 80*b* formed on the bottom foundation block 90 are shown explicitly.

Figure 9:
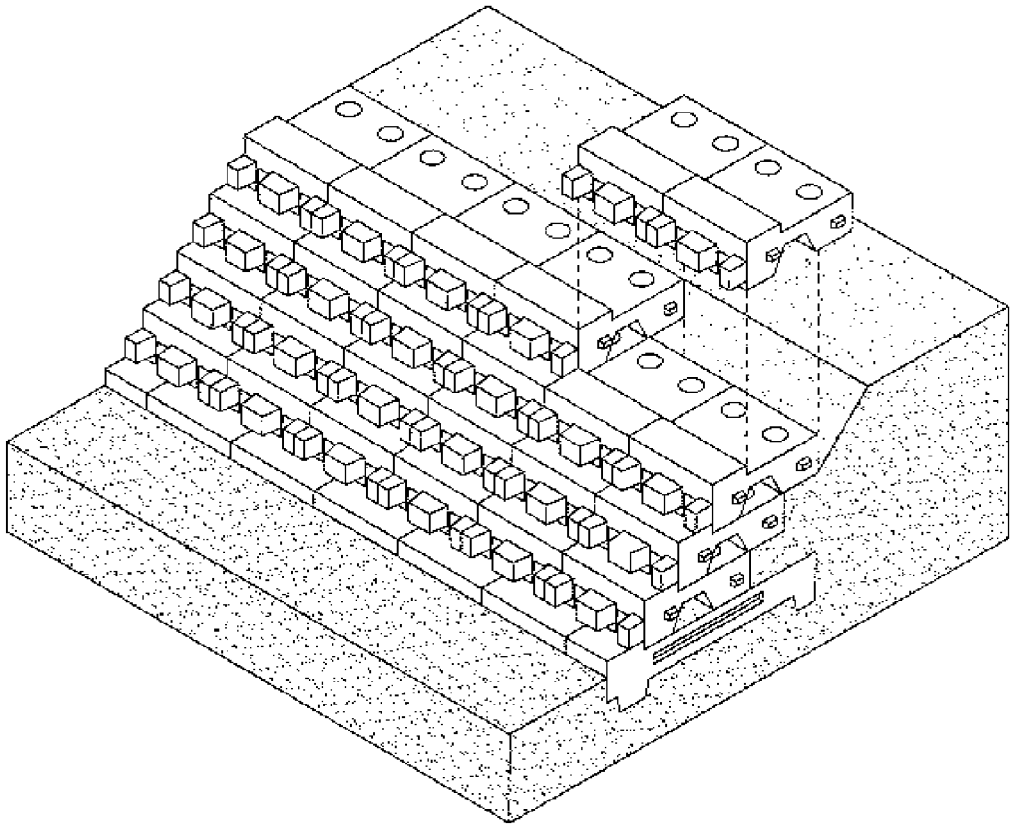
FIG. 9 is an exemplary view of assembly with no space for plants.

FIG. 9 is an exemplary view of assembly of the base block 10 and the bottom foundation block 90 with no space for plants 20.

Figure 10:
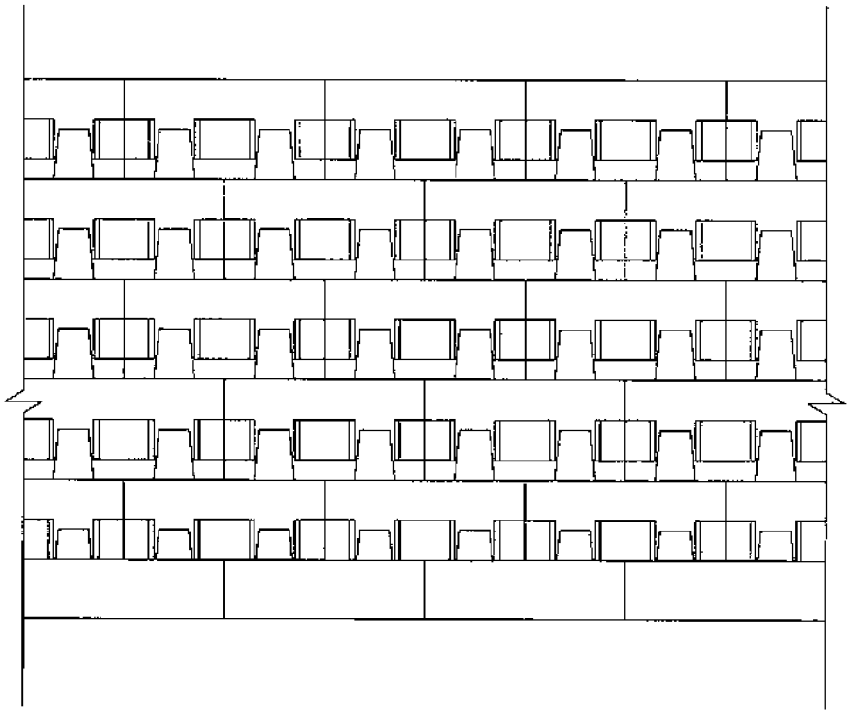
FIG. 10 is a front view illustrating assembly of the bottom foundation block and the base block of the present invention.

Lastly, FIG. 10 is a front view illustrating assembly of the bottom foundation block 90 and the base block 10 of the present invention.

INDUSTRIAL APPLICABILITY

While the present invention has been described in detail with reference to the preferred embodiments, it is not limited to the embodiments and thus those skilled in the art will appreciate that various modifications and substitutions can be made thereto without departing from the spirit and scope of the present invention as set forth in the appended claims.

The invention claimed is:

1. A hydrophilic revetment block constructed on seashores, harbors, rivers, reservoirs or dams is provided, and comprising at least one base block and at least one bottom foundation block, said base block comprises:

a block structure having a square, trapezoidal, or reverse trapezoidal cross section in the horizontal direction and having a plurality of water inlets, a space for water outflow and fish growing and a plurality of water outlets;

a stepped part for preventing push, which is formed on a certain section of the top of the block structure;

a plurality of projections and indentations for engagement with neighboring blocks, formed on both sides of the block structure for preventing differential settlement;

an optional space for plants formed on a certain section of the stepped part for preventing push, where plants can grow; and a plurality of projections formed on the front of the block structure, which reduce the rate of water flow, dissipate waves and offer stairs to be used for means for human travel;

wherein the plurality of water inlets formed in between the projections are of the same size and connected to the space for water outflow and fish growing at the bottom of the block structure, the space for water outflow and fish growing formed at the bottom of the block structure has a larger cross section than the water inlets, has a trapezoidal shape when viewed from the side of the block and meets with the water inlets in "T" form, and said plurality of water outlets are formed with a slope from the top of the block structure to the space for water outflow and fish growing formed at the bottom of the block structure, and said plurality of water inlets and said plurality of water outlets completely dissipate residual energy, thereby pacifying water flow and offering a living space for fish, and said plurality of water outlets located at the top of the base block within the area of the top of the base block forming the bottom of the space for water outflow of a second base block and fluidly connected therewith if said second base block were stacked on top of said base block with the front of said second base block in contact with the vertical portion of the stepped part on the top of said base block;

and said bottom foundation block of a hydrophilic revetment block formed at the bottom of the said base block, which comprises:

a block structure which is longer than the base block to ensure stable construction;

a pair of projections formed at the top of the block structure which engage with the bottom of the base block and prevents the base block from being pushed along the longitudinal direction of the block;

a pair of projections formed at the bottom of the block structure with a predetermined spacing for increasing friction with the ground; and projections and indentations for engagement with neighboring blocks formed on both sides of the block structure, which engage with each other to prevent differential settlement;

wherein one of the pair of projections for preventing push is formed on the front of the block structure and has a square shape when viewed from the side of the block and the other is formed in the middle of the block structure and has a trapezoidal shape when viewed from the side of the block and the pair of projections for preventing push are formed with a predetermined spacing, so that they may engage with the bottom of the base block, and the trapezoidal projections, which engage with the space for water outflow and fish growing of the base block, are formed below the trapezoidal space for water outflow and fish growing in order to offer living space for fish, and said trapezoidal space is closed to upward and downward to make space safe from outside circumstances and connected to one or more of said plurality of water inlets.

2. The hydrophilic revetment block of claim 1 further includes a side end block of a hydrophilic revetment block constructed at each end, which comprises:

a block structure having a plurality of stairs; and a plurality of trapezoidal projections for engagement formed on the left side or right side of the block structure;

wherein the plurality of projections for engagement are aligned with a slope and with a predetermined spacing, so that they engage with the space for water outflow and fish growing of the base block.

3. The hydrophilic revetment block of claim 2 further includes a top end block constructed at the top of the hydrophilic revetment block, which comprises:

a block structure having a plurality of water inlets, a space for water outflow and fish growing and a plurality of water outlets;

a stepped part for preventing push formed on a certain section of the top of the block structure;

a plurality of projections and indentation for engagement with neighboring blocks, which are formed on either side of the block structure and are engaged with each other to prevent differential settlement;

a space for plants formed at a certain section of the stepped part for preventing push; and a plurality of projections formed on it front of the block structure, which reduces inflow rate, dissipates waves and offers stairs to be used for means for human travel;

wherein the plurality of water inlets through which water can flow in are formed between the projections with the same size and are connected to the space for water outflow and fish growing below the block structure, the space for water outflow and fish growing has a cross section larger than the water inlets and have a trapezoidal shape when viewed from the side of the block, and it meets with the water inlets in "T" form, the stepped part for preventing push is higher than the stepped part for preventing push of the base block, so that water may not flow over the block, and the plurality of water outlets are connected to the space for water outflow and fish growing in a vertical direction, so that water which flows over the block, if any, may immediately flow out to the space for water outflow and fish growing.

4. The hydrophilic revetment block of claim 1, wherein at least one base block comprises a space for plants.

5. The hydrophilic revetment block of claim 4, wherein for at least one base block natural stone or patterned stone is laid in the space for plants.

6. The hydrophilic revetment block of claim 1, wherein the front of at least one of the base blocks is formed in a streamlined pattern or other pattern.

7. The hydrophilic revetment block of claim 1, wherein at least one of the base blocks has a trapezoidal or reverse trapezoidal horizontal cross section, so that it can be constructed in curved region.

8. A construction method using, the hydrophilic revetment block of claim 1 on seashore, rivers, reservoir, dam, etc., which comprises the steps of:

constructing one or more foundation blocks and base blocks with the base blocks approximately centered over the engagement between adjacent foundation blocks; and stacking the base blocks repeatedly with base blocks approximately centered over the engagement between adjacent base blocks in the row below.

9. A construction method using the hydrophilic revetment block of claim 3 on seashore, river, reservoir, dam, etc., which comprises the steps of:

fixing the projections for fixation of the bottom foundation block at the ground;

connecting the bottom foundation blocks horizontally while engaging each projection for engagement of the bottom foundation block with the each indentation for engagement of the bottom foundation block;

constructing the base block on the bottom foundation block with the base block approximately centered over the engagement between adjacent foundation blocks by engaging the trapezoidal projections for preventing push of the bottom foundation block with the trapezoidal space for water outflow and fish growing of the base block;

connecting the base blocks horizontally while engaging each projection for engagement of the base block with each indentation for engagement of the base block;

stacking the base block on the base block repeatedly with base blocks approximately centered over the engagement between adjacent base blocks in the row below;

finishing both ends by engaging the plurality of trapezoidal projections for engagement formed on the left or right side of the side end block with the space for water outflow and fish growing of the base block; and finishing the top by stacking the top end block on top of the base block repeatedly with the top end blocks approximately centered over the engagement between adjacent base blocks in the row below.

* * * * *